US007678321B2

(12) United States Patent
Sirdesai et al.

(10) Patent No.: US 7,678,321 B2
(45) Date of Patent: Mar. 16, 2010

(54) CLEAR AND RESILIENT ARTIFICIAL FINGERNAIL TIP

(75) Inventors: Sunil J. Sirdesai, Irvine, CA (US); George Schaeffer, Beverly Hills, CA (US)

(73) Assignee: OPI Products, Inc., North Hollywood, CA (US)

( * ) Notice: Subject to any disclaimer, the term of this patent is extended or adjusted under 35 U.S.C. 154(b) by 1390 days.

(21) Appl. No.: 10/989,983

(22) Filed: Nov. 15, 2004

(65) Prior Publication Data

US 2006/0102189 A1 May 18, 2006

(51) Int. Cl.
*C08J 5/00* (2006.01)

(52) U.S. Cl. ..... 264/331.11; 264/331.21; 264/241; 264/328.1; 264/328.17; 264/331.18; 132/73; 132/200

(58) Field of Classification Search ..... 264/331.11, 264/239, 263, 266, 294, 328.1, 244, 246, 264/247; 132/73, 200
See application file for complete search history.

(56) References Cited

U.S. PATENT DOCUMENTS

| | | | | |
|---|---|---|---|---|
| 3,993,084 | A | 11/1976 | Cullen | |
| 4,007,748 | A | 2/1977 | Matranga et al. | |
| 4,135,526 | A | 1/1979 | Matranga et al. | |
| 4,157,095 | A | 6/1979 | Sweet | |
| 4,299,243 | A | 11/1981 | Umstattd | |
| 4,346,720 | A | 8/1982 | Hokama | |
| 4,359,435 | A * | 11/1982 | Kogure | 264/40.5 |
| 4,625,740 | A | 12/1986 | Roth | |
| 4,632,134 | A | 12/1986 | Reid | |
| 4,664,732 | A * | 5/1987 | Campbell et al. | 156/158 |
| 4,671,305 | A | 6/1987 | Mann | |
| 4,751,935 | A | 6/1988 | Mast et al. | |
| 4,779,632 | A | 10/1988 | Howa et al. | |
| 4,924,889 | A | 5/1990 | Schaeffer et al. | |
| 4,979,523 | A | 12/1990 | Grimm | |
| 4,988,883 | A | 1/1991 | Oppawsky | |
| 5,070,892 | A | 12/1991 | Trematerra | |
| 5,127,414 | A | 7/1992 | Mast et al. | |
| 5,309,365 | A | 5/1994 | Sullivan et al. | |
| 5,372,150 | A | 12/1994 | Hughes | |
| 5,513,664 | A | 5/1996 | Krupsky | |
| 5,675,989 | A | 10/1997 | Abraskin | |
| 5,832,936 | A | 11/1998 | Pruchnic et al. | |
| 5,860,429 | A | 1/1999 | Chang | |
| 5,897,853 | A | 4/1999 | Unser | |
| 5,944,027 | A | 8/1999 | Chang | |
| 5,968,302 | A * | 10/1999 | Gifford | 156/245 |
| 6,382,217 | B2 | 5/2002 | Coker et al. | |
| 2001/0032654 | A1 | 10/2001 | Coker et al. | |
| 2002/0129827 | A1 * | 9/2002 | Chang | 132/73 |
| 2004/0097662 | A1 * | 5/2004 | Gaggar et al. | 525/469 |

OTHER PUBLICATIONS

Plaskolite: Continental Acrylics, Dec. 12, 2002, www.plaskolitecontinental.com/index1.html, pp. 1-2.*

* cited by examiner

*Primary Examiner*—Jeffrey Wollschlager
*Assistant Examiner*—Stella Yi
(74) *Attorney, Agent, or Firm*—Blakely, Sokoloff, Taylor & Zafman

(57) ABSTRACT

A method for making clear and resilient artificial fingernail tips which can be applied to the forward edge of the natural fingernail using a mixture of copolymer pellets which form a plastic phase and terpolymer pellets which form a rubber phase; drying the pellets, melting the pellets, injecting the molten material into a mold to form the desired artificial fingernail tips.

17 Claims, No Drawings

CLEAR AND RESILIENT ARTIFICIAL FINGERNAIL TIP

FIELD OF INVENTION

This invention pertains to compositions that are useful for making clear and resilient artificial fingernail tips used to extend the natural fingernail and enhance the appearance of the wearer's natural fingernail.

BACKGROUND OF THE INVENTION

The prior art does reveal inventions of artificial fingernail tips. Most of these fingernail tips are natural in color and lack transparency demanded by today's women. These natural colored fingernail tips are typically made from acrylonitrile-butadiene-styrene (ABS) polymer. Additives like titanium dioxide are added to increase the opacity of these artificial fingernails. A fast curing cyanoacrylate glue is applied on the edge of this fingernail tip and held firmly on the natural fingernail for a few seconds. These fingernail tips are resilient, but they are not clear. This is the biggest impediment to today's women where fashion demands that nail art be done on a transparent fingernail tip.

The prior art mentioned below discusses translucent/opaque fingernail tips. The prior art also teaches methods of reinforcing these fingernail tips with acrylics. Matranga and Hokama in U.S. Pat. No. 4,007,748 describe an artificial nail tip with a convex peripheral edge made from a thin plastic sheet in order to securely bond to the natural nail. These same inventors in U.S. Pat. No. 4,135,526 describe using a rapid drying glue to affix these artificial tips to natural nails. Sweet in U.S. Pat. No. 4,157,095 discusses using a hardenable polymeric material over the natural and artificial portion of the nail to reinforce the artificial nailtip. Hokama in U.S. Pat. No. 4,346,720 discusses the design of artificial fingernail tips made of acetate resins, which are translucent. Roth in U.S. Pat. No. 4,625,740 discusses the novel design of nail tips that enhance structural integrity and reduces breaking, cracking, and dislodgment of the device and other disadvantages associated with the prior art. Reid in U.S. Pat. No. 4,632,134 describes using linen over artificial nail tips attached to natural nails as means of reinforcing this system. Mann in U.S. Pat. No. 4,671,305 describes using a fabric within a plastic sheet as a means of reinforcing an artificial fingernail tip. Mast in U.S. Pat. No. 4,751,935 discusses using an artificial nail tip with slightly roughened texture at the front end and pigmented whitish distal end in order to simulate natural nail. Trematerra in U.S. Pat. No. 5,070,892 discusses a recessed rear portion with a predisposed edge pattern, which facilitates more efficient and effective attachment to natural nails. Krupsky in U.S. Pat. No. 5,513,664 discusses the methodology of constructing artificial fingernails. Pruchnic, et al. in U.S. Pat. No. 5,832,936 discuss graduated fingernail tips and their application to natural nails. Chang in U.S. Pat. No. 5,944,027 discloses a method for forming a dual component artificial fingernail tip or French (pink and white) tips. In U.S. patent application 20010032654, Coker, et al., discuss the process for fabricating custom fit removable and reusable metal fingernails.

Though not mentioned in the prior art patents, clear fingernail tips do exist and are used by women to do nail art. However, these fingernail tips are less than desirable because they fog when cyanoacrylate glue is applied on the artificial fingernail. This phenomenon of fogging happens when there is wide disparity in refractive index (RI) between the artificial nail tip material and glue. This is not a problem with natural colored fingernail tips because they already are translucent or opaque. This phenomenon of fogging happens because the fingernail tip material is either ABS or polystyrene or polycarbonate. The glue that is used to affix this artificial fingernail onto natural nail belongs to a different family known as acrylates. The RI of cyanoacrylates is 1.45 while the RI of polystyrene is 1.59. The RI of polycarbonate is 1.58 and natural ABS is milky white. Moreover, ABS and polystyrene are brittle and they have poor mechanical properties. Additives can be added to enhance the mechanical properties but these additives do little to improve optical properties. Clear fingernail tips made from polycarbonate exhibit good mechanical properties but they have a tendency to yellow in the presence of air. Applying cyanoacrylate glue to the edge of this fingernail tip will create a fog like appearance due to disparity in RI.

Clear nail tips of unknown material sold by EZ Nails do not fog when cyanoacrylate glue is applied. But they are not resilient and exhibit poor mechanical properties i.e. they are prone to cracking or breaking upon a slight impact.

Advances in the design of artificial fingernail tips and the methodology to attach these tips to natural fingernails have significantly reduced the incidences of mold or fungus that occur between the natural and artificial nail. However, there still exists a finite chance of getting this condition. If left untreated, mold or fungus can cause irreversible damage to the natural nail. Fogging of the artificial nail impedes the visual determination of the onset of mold or fungus which will be noticed only at a much later stage.

As described above, fingernail tips are used to improve the aesthetic appearance of the wearer's fingernails. The following protocol is normally used for applying these nail tips.

Natural nail is slightly roughed with a nail file.

Artificial fingernail tips come in various sizes and shapes in order to fit shape and size of natural nails. The right sized tip is selected such that when applied will give an appearance of a long "natural" nail.

Cyanoacrylate glue is then applied on the edge of concave portion of proximal end.

This tip is then quickly pressed firmly against the natural nail. Care should be taken to see that there are no air bubbles trapped when the glue is cured. These air bubbles are a source of mechanical failure and breeding spaces for molds/fungus as these crevices can trap moisture.

The edge of the artificial nail tip is then filed and blended with the natural nail.

This step is optional. Apply acrylic to the artificial and natural fingernail to provide an additional layer of reinforcement at the seam of the natural and artificial fingernails.

In the protocol mentioned above, the glue starts curing as soon as it comes into contact with the air. Hence it is critical that this procedure be carried out as speedily as possible.

SUMMARY OF THE INVENTION

This invention relates to an improved clear artificial nail tip which does not fog when dabbed with nail glue. The invented artificial nail tip, unlike the prior art, is durable, non-yellowing and exhibits superior mechanical and optical properties. The clarity of the material used to fabricate the nail tips allows for the early detection of the onset of mold/fungus.

DETAILED DESCRIPTION OF THE INVENTION

This invention relates to the material and process used to manufacture a very clear artificial nail tip that is attached to a human nail with help of fast drying cyanoacrylate glue. This invention also relates to an artificial nail tip that is clear enough to visually detect the early onset of mold/fungus.

As noted above, to obtain a clear nail tip, it is necessary to use a material with a RI that is close to the RI of cyanoacrylate glue. In an embodiment, the material used is manufactured and sold as pellets by Plaskolite Continental Polymers of Compton, California as CA 2000 Clear. The material is a mixture of copolymer and terpolymer. The copolymer forms the plastic phase and copolymer grafted on terpolymer forms the rubber phase. This will form part of amorphous domain in the polymer and form the rubber phase and contribute to increasing resiliency. Thus, one pellet is copolymer while the other is a copolymer grafted on terpolymer. The plastic phase is made of methyl methacrylate—ethyl acrylate and the rubber phase is made of butyl acrylate-butadiene-methyl methacrylate backbone with methyl methacrylate—ethyl acrylate grafts. The ratio of copolymer pellets to copolymer grafted on terpolymer pellets is about 70% copolymer and 30% copolymer grafted on terpolymer. The RI of this material is 1.49 compared to RI of cyanoacrylate glue which is 1.45. The table below lists refractive indices of various materials.

| Material | RI |
|---|---|
| Cyanoacrylate | 1.45 |
| CA 2000 | 1.49 |
| Polystyrene | 1.59 |
| Polycarbonate | 1.58 |
| ABS | Milky white |

The table below lists typical luminous transmittance of transparent materials. The % light transmittance is compared with that of glass.

| Material | % Light Transmittance |
|---|---|
| Glass | 92 |
| CA 2000 | 91 |
| Polycarbonate | 90 |
| Polystyrene | 90 |

In order to obtain an extremely clear and glossy fingernail tip from this material, stringent conditions have to be met. The polymer pellets need to be predried for about three to four hours at approximately 175-185 deg. F. before molding commences. To accomplish this, the pellets are baked on a sheet. The heater should have an opening on the top for displacing moisture adsorbed on the pellets. Ideally one should use a vacuum to suck moisture. This predrying step is mandatory because raw acrylate pellets absorb moisture from the atmosphere. This moisture, if not got rid off, is a cause of haziness in the fingernail tip. For optimum clarity and surface gloss, all mold surfaces should be stainless steel and the surfaces should be controlled at approximately 120-140 deg. F. Machine hoppers, cylinders, barrels, screws, valves etc. should be thoroughly cleaned because extraneous matter will cause haziness. Injection molding conditions also need to be adhered in order to obtain a clear and glossy nail tip. The melt temperature should be maintained between approximately 410 and 470 deg. F. The molding temperature should be between 104-158 deg. F. during injection and molding which takes about eight seconds. The injection speed should be slow to moderate and the injection pressure should be between approximately 10000 and 20000 psi. The speed is adjusted such that the finished product meets the requisite parameters. The specific speed adjustments which may be needed would be well within the abilities of persons skilled in the art. After cooling to about 98 deg. F. (warm to touch) for about 3.2 seconds, the tip is released from the mold. The entire cycle of injecting, maintaining temperature in the molds and cooling is approximately 11.2 seconds.

The molds need to be vented 0.5 mil in order to drive the gases from the mold to obtain the correct design of the tip. Because the pellets have a high glass transition temperature as compared with ABS and other materials used for artificial fingernail tips, a higher injection temperature is used than would be the case with prior art materials. The higher temperature introduces more gases in the mold. For tips made with ABS etc., a lower temperature will introduce less gases and venting of the mold using vents sized less than 0.5 mil is sufficient to drive the gases out of the mold in the finite time frame during the process of molding. However, when using the pellets contemplated by this invention, a vent size less than 0.5 mil is not large enough to allow the gases to escape. These gases prevent the melted polymer from reaching the ends of the mold which results in tips having rounded (blunt) edges as opposed to sharp points. Hence, to address this problem, it is necessary to use a vent size which is sufficient to allow gases to escape, but is not wide enough for the melted polymer to flow out. A vent size of substantially equal to 0.5 mil in most cases will meet this requirement.

The actual molds used have the same configuration as molds used to make prior art artificial nail tips. The mold equipment used is also the same as used to make prior art artificial nail tips provided that the above described temperatures and other conditions described above are satisfied.

The invented technique utilizes higher temperature and pressure along with more venting in the mold as compared with techniques used to manufacture prior art nail tips. The nail tips are made with a proximal extension that juts out and a proximal end that overlaps roughly one third of the natural nail. Various sizes and curvatures are manufactured for the best fit to the nail.

After the manicurist selects the right fingernail tip manufactured according to the invention, a fast drying cyanoacrylate adhesive is applied to the concave edge of the proximal end that will overlap roughly one third of the natural nail. This proximal end is held tightly by the manicurist between her thumb and forefinger for few seconds. This artificial tip is now bonded to the natural nail. The proximal extension is then cut to match client's preferred length. At this stage, the manicurist has three choices. The manicurist can file the seam and flush it with the natural nail, or use acrylic liquid and powder to reinforce the artificial nail or use layers of cyanoacrylate glue with or without wrap to enforce the nail. Irrespective of the method selected by the manicurist and the client, the end product will be clear and will exhibit superior optical and mechanical properties than its competition.

The invention also contemplates the clarity of these tips would alert the user/manicurist of the onset of the mold or fungus almost immediately thereby eliminating the need for long treatments needed to eliminate the mold/fungus when detected at a later stage. In extreme cases, if the fungus goes undetected that could lead to irreversible damage to the natural nail including lifting of the natural nail.

We claim:

1. A method of making an artificial fingernail tip comprising:

melting a material comprising a mixture of copolymer pellets and copolymer grafted on terpolymer pellets, the copolymer pellets comprising methyl methacrylate-ethyl acrylate and the terpolymer pellets comprising butyl acrylate-butadiene-methyl methacrylate backbone with methyl methacrylate-ethyl acrylate grafts; and molding the melted material to have a shape of the artificial fingernail tip, wherein the artificial fingernail has a refractive index substantially the same as a refractive index of a cyanoacrylate glue, and wherein the artificial fingernail tip is transparent.

2. The method defined by claim 1 wherein the copolymer pellets form a plastic phase and the copolymer grafted on terpolymer pellets form a rubber phase during melting.

3. The method defined by claim 2 wherein the material comprises about 70% copolymer pellets and about 30% copolymer grafted on terpolymer pellets.

4. The method defined by claim 2 further comprising:

drying the copolymer and copolymer grafted on terpolymer pellets by baking at a temperature of approximately 175-185 deg. F. for about 3-4 hours prior to the melting.

5. The method of claim 1, wherein molding the melted material is performed in a mold having a vent size not less than 0.5 mil.

6. The method of claim 1, further comprising drying the material before melting the material, wherein said drying the material comprises baking the material.

7. The method of claim 6, wherein drying comprises heating to a temperature of at least 175 deg. F.

8. The method of claim 6, wherein drying the material comprises using a vacuum.

9. The method of claim 1, wherein molding the melted material comprises using an injection pressure ranging from 10000 to 20000 psi.

10. The method of claim 1, wherein molding the melted material comprises using a molding temperature ranging from 104 to 158 deg. F.

11. The method of claim 1, wherein the artificial fingernail tip has a refractive index of less than 1.58, and wherein the refractive index of the cyanoacrylate glue is about 1.45.

12. A method of making artificial fingernail tips comprising:

a) obtaining a mixture of about 700o copolymer pellets and about 30% copolymer grafted on terpolymer pellets, the copolymer pellets comprising methyl methacrylate-ethyl acrylate and the terpolymer pellets comprising butyl acrylate-butadiene-methyl methacrylate backbone with methyl methacrylate-ethyl acrylate grafts;

b) drying the copolymer and copolymer grafted on terpolymer pellets by baking at a temperature of approximately 175-185 deg. F. for about 3-4 hours;

c) melting the dried pellets at a temperature between approximately 410 and 470 deg. F. to form a melted material;

d) injecting the melted material into a mold at a pressure between approximately 10000 and 20000 psi;

e) maintaining a molding temperature of approximately 104-158 deg. F. and mold surfaces at approximately 120-140 deg. F. for approximately eight seconds;

f) maintaining the material at a temperature of approximately 98 deg. F. for approximately 3.2 seconds until the material hardens;

g) removing the hardened material forming the artificial fingernail tips, wherein the hardened material has a refractive index substantially the same as an about 1.45 refractive index of a cyanoacrylate glue such that fogging would not occur if the cyanoacrylate glue were applied to the hardened material.

13. The method defined by claim 12 wherein the mold includes a vent sized sufficient to allow gases to escape and preventing the melted material from flowing out.

14. The method defined by claim 13 wherein the vent size is substantially equal to 0.5 mil.

15. The method defined by claim 12 wherein the copolymer pellets form a plastic phase and the copolymer grafted on terpolymer pellets form a rubber phase.

16. A method of making an artificial fingernail tip comprising:

drying a material including baking the material to remove moisture from the material;

melting the dried material, the material comprising a mixture of about 70% copolymer pellets and about 30% copolymer grafted on terpolymer pellets, the copolymer pellets comprising methyl methacrylate-ethyl acrylate and the terpolymer pellets comprising butyl acrylate-butadiene-methyl methacrylate backbone with methyl methacrylate-ethyl acrylate grafts;

molding the melted material into a shape of an artificial fingernail tip;

wherein the artificial fingernail tip has a refractive index such that fogging would not occur if a cyanoacrylate glue were applied to the artificial fingernail tip, and wherein the artificial fingernail tip is transparent.

17. The method of claim 16, wherein molding comprise venting gases through a vent sized no less than 0.5 mil.

* * * * *

UNITED STATES PATENT AND TRADEMARK OFFICE

CERTIFICATE OF CORRECTION

PATENT NO. : 7,678,321 B2
APPLICATION NO. : 10/989983
DATED : March 16, 2010
INVENTOR(S) : Sirdesai et al.

It is certified that error appears in the above-identified patent and that said Letters Patent is hereby corrected as shown below:

In Column 5, Claim 12, line 40, delete "700o" and insert -- 70% --

Signed and Sealed this

Thirteenth Day of July, 2010

David J. Kappos

David J. Kappos
*Director of the United States Patent and Trademark Office*